US010390569B2

(12) United States Patent
Winget

(10) Patent No.: US 10,390,569 B2
(45) Date of Patent: Aug. 27, 2019

(54) YOGA BAND LEGGINGS AND METHOD OF MANUFACTURING THE SAME

(71) Applicant: Lennon Leasing, LLC, Corona, CA (US)

(72) Inventor: Patrick Winget, Monrovia, CA (US)

(73) Assignee: LENNON LEASING, LLC, Corona, CA (US)

( * ) Notice: Subject to any disclaimer, the term of this patent is extended or adjusted under 35 U.S.C. 154(b) by 121 days.

(21) Appl. No.: 15/489,636

(22) Filed: Apr. 17, 2017

(65) Prior Publication Data

US 2017/0295857 A1 Oct. 19, 2017

Related U.S. Application Data

(60) Provisional application No. 62/324,262, filed on Apr. 18, 2016.

(51) Int. Cl.

| | |
|---|---|
| ***A41D 1/08*** | (2018.01) |
| ***A41F 9/02*** | (2006.01) |
| ***D05B 1/00*** | (2006.01) |
| ***D06C 11/00*** | (2006.01) |
| ***A41B 11/14*** | (2006.01) |

(52) U.S. Cl.
CPC ..... *A41B 11/14* (2013.01)

(58) Field of Classification Search
CPC ..... A41D 1/08; A41B 11/14
See application file for complete search history.

(56) References Cited

U.S. PATENT DOCUMENTS 1,548,534 A * 8/1925 Lapporte ..... A41B 9/04 2/407
1,883,263 A * 10/1932 Wright ..... A41F 9/02 2/237
1,966,651 A * 7/1934 Snader ..... A41B 9/04 2/237
2,800,761 A * 7/1957 Stuart ..... C03C 25/16 57/297
3,063,126 A * 11/1962 Tingas ..... D06C 29/00 26/29 R

OTHER PUBLICATIONS

McCall's 1940's WW2 Pattern, Retrieved on Feb. 16, 2019 from "https://www.thevintagepatternshop.com/shop/vintage-sewing-patterns/1940s-ww2-vintage-sewing-pattern-w38-mens-pants-trousers-1311/".*

* cited by examiner

*Primary Examiner* — Anna K Kinsaul
(74) *Attorney, Agent, or Firm* — Snell & Wilmer LLP

(57) ABSTRACT

A method of manufacturing leggings having a leg portion and a waistband portion, using a fabric is disclosed. The method includes brushing an outside surface of the fabric once to form a single-brushed surface. The method includes brushing an inside surface of the fabric multiple times to form a multiple-brushed surface. The method includes cutting the fabric into a plurality of pieces for the leg portion and a plurality of pieces for the waistband portion and sewing the pieces together, the waistband portion having a top edge and a bottom edge, the top edge of the waistband portion being narrower than the bottom edge of the waistband portion, the single-brushed surface of the fabric forming an inside legging surface configured to contact a wearer, and the multiple-brushed surface of the fabric forming an outside legging surface. The method includes sewing an elastic band to the top edge of the waistband.

16 Claims, 7 Drawing Sheets

YOGA BAND LEGGINGS AND METHOD OF MANUFACTURING THE SAME

CROSS REFERENCE TO RELATED APPLICATIONS

This application claims the benefit and priority of U.S. Provisional Application No. 62/324,262, filed on Apr. 18, 2016, entitled "Process of Manufacturing A Yoga Band Legging," the contents of which are herein incorporated by reference in its entirety.

BACKGROUND

1. Field

This specification relates to yoga band leggings and a method for manufacturing yoga band leggings.

2. Description of the Related Art

Pants have been worn by human beings for many centuries. Pants are typically worn on legs. Pants may include one or more pockets, zippers, or buttons. Pants may include belt loops or suspender buttons. Pants may be of varying lengths, ranging from knee-length to ankle-length.

SUMMARY

What is described is a method for manufacturing leggings having a leg portion and a waistband portion. The method includes brushing an outside surface of the fabric once to form a single-brushed surface. The method also includes brushing an inside surface of the fabric multiple times to form a multiple-brushed surface. The method also includes cutting the fabric into a plurality of leg pieces for the leg portion and a plurality of waistband pieces for the waistband portion. The method also includes sewing or stitching the plurality of leg pieces for the leg portion and the plurality of waistband pieces for the waistband portion together, the waistband portion having a top edge and a bottom edge, a length of the top edge of the waistband portion being smaller than a length of the bottom edge of the waistband portion, the bottom edge of the waistband portion being connected to a top edge of the leg portion, the single-brushed surface of the fabric forming an inside leg surface configured to contact legs of a wearer of the leggings, and the multiple-brushed surface of the fabric forming an outside leg surface. The method also includes sewing or stitching an elastic band to the top edge of the waistband portion.

Also described is yoga band leggings made of a fabric. The yoga band leggings include a waistband portion configured to wrap around a wearer, the waistband portion having a top waistband edge, a bottom waistband edge, an elastic band located along the top waistband edge, a length of the top waistband edge being smaller than a length of the bottom waistband edge. The yoga band leggings also include a leg portion having an inside leg surface configured to contact legs of the wearer, an outside leg surface, and a top leg edge connected to the bottom waistband edge of the waistband portion, the outside leg surface formed from a first side of the fabric and the inside leg surface formed from a second side of the fabric, the first side of the fabric being brushed multiple times and the second side of the fabric being brushed one time.

BRIEF DESCRIPTION OF THE DRAWINGS

Other systems, methods, features, and advantages of the present invention will be apparent to one skilled in the art upon examination of the following figures and detailed description. Component parts shown in the drawings are not necessarily to scale, and may be exaggerated to better illustrate the important features of the present invention.

DETAILED DESCRIPTION

Disclosed herein are yoga band leggings and methods of manufacturing yoga band leggings. Pants have been worn by human beings for centuries. Pants may come in many shapes and sizes, and may be made of many materials. However, some pants may be made of materials and may be assembled in such a manner which makes them uncomfortable to wear for an extended period of time. One type of pants are leggings. Leggings may be made of a fabric having an elastic property, allowing them to stretch. While leggings may be more comfortable than some other types of pants, they still suffer from the shortcomings common to uncomfortable pants, such as being made of a fabric which is unpleasant when worn for an extended period of time.

Figure 1:
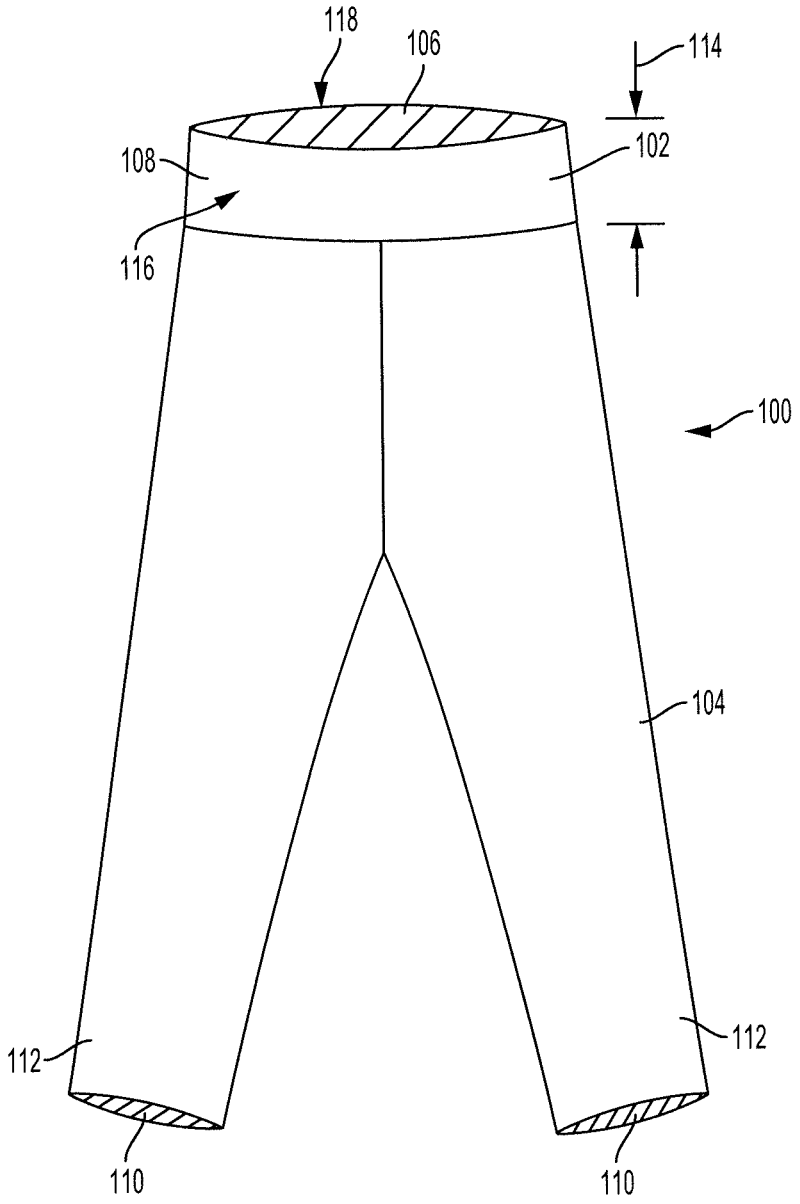
FIG. 1 is a front view of yoga band leggings, according to an aspect of the invention.

FIG. 1 is a front view of yoga band leggings, according to an aspect of the invention. The yoga band leggings 100 have a waistband portion 102 and a leg portion 104. The waistband portion 102 is configured to be worn around a user's waist, and the leg portion 104 is configured to be worn around the user's legs, in a manner similar to traditional pants. The waistband portion 102 and the leg portion 104 are made of the same fabric. In some embodiments, the waistband portion 102 and the leg portion 104 are made of different fabrics.

The waistband portion 102 has an outer surface 108 and an inner surface 106. The inner surface 106 of the waistband portion 102 is configured to contact the wearer around the wearer's waist area. The leg portion 104 has an inner leg surface 110 and an outer leg surface 112. The inner leg surface 110 of the leg portion 104 is configured to contact the wearer at the wearer's leg area. The outer surface 108 of the waistband portion 102 and the outer leg surface 112 of the leg portion are configured to be exposed. Accordingly, the outer surfaces 108 and 112 may be processed so that they are soft when touched by human hands or human skin. A soft hand feel is appealing to wearers of the yoga band leggings 100 and may be a distinguishing factor between wearing the yoga band leggings 100 and other pants.

The waistband portion 102 may have a waistband width 114. The waistband width 114 may be between two inches and seven inches. A wider waistband width 114 provides increased comfort to the wearer of the yoga band leggings 100, as the force of the waistband surrounding the waist of the wearer is distributed over a wider area, as compared to a narrower waistband, which concentrates the force of the waistband over a smaller area.

Figure 4A:
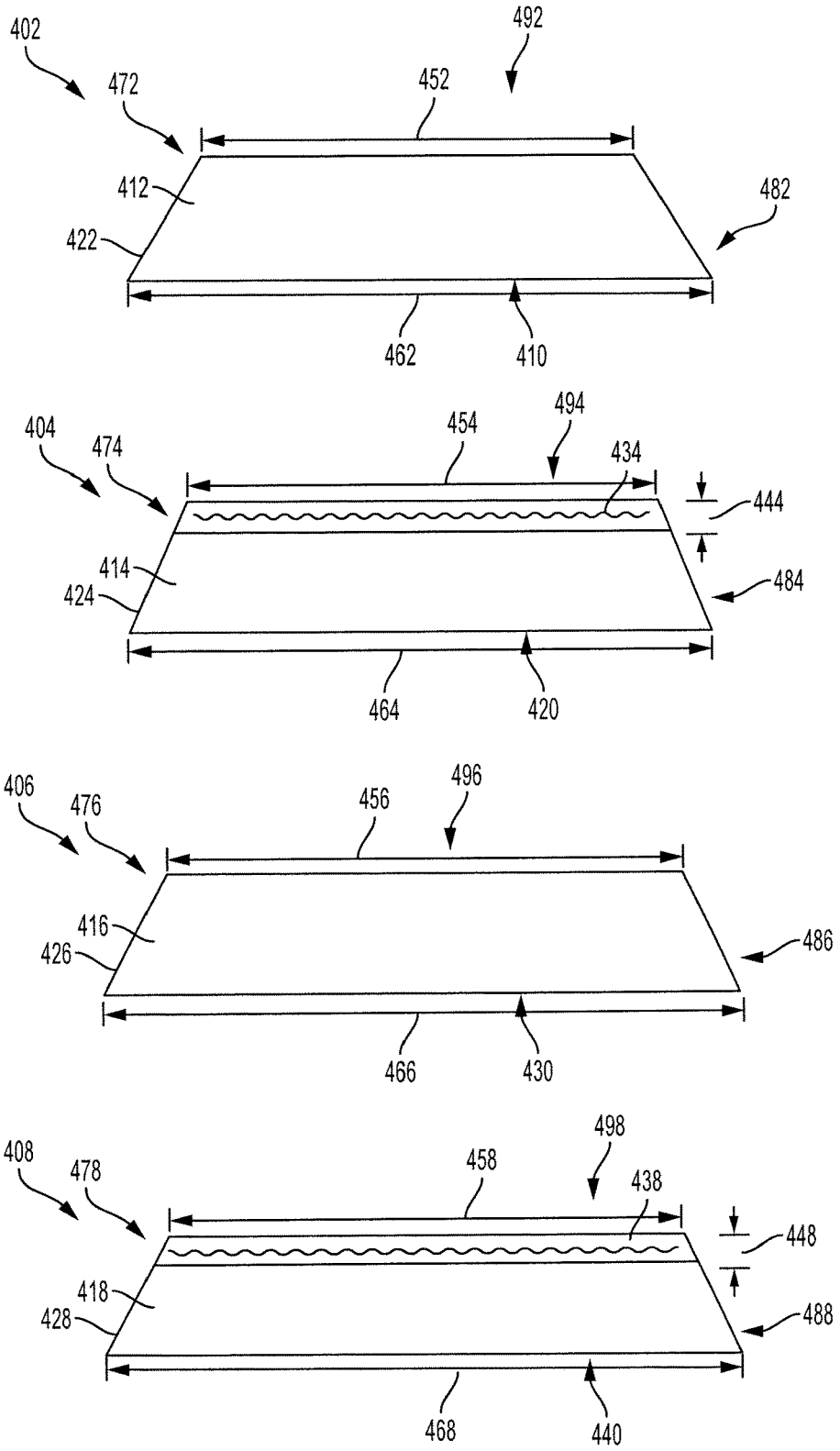
FIG. 4A illustrates front views of four pieces used to make a waistband portion of the yoga band leggings, according to an aspect of the invention.
Figure 4B:
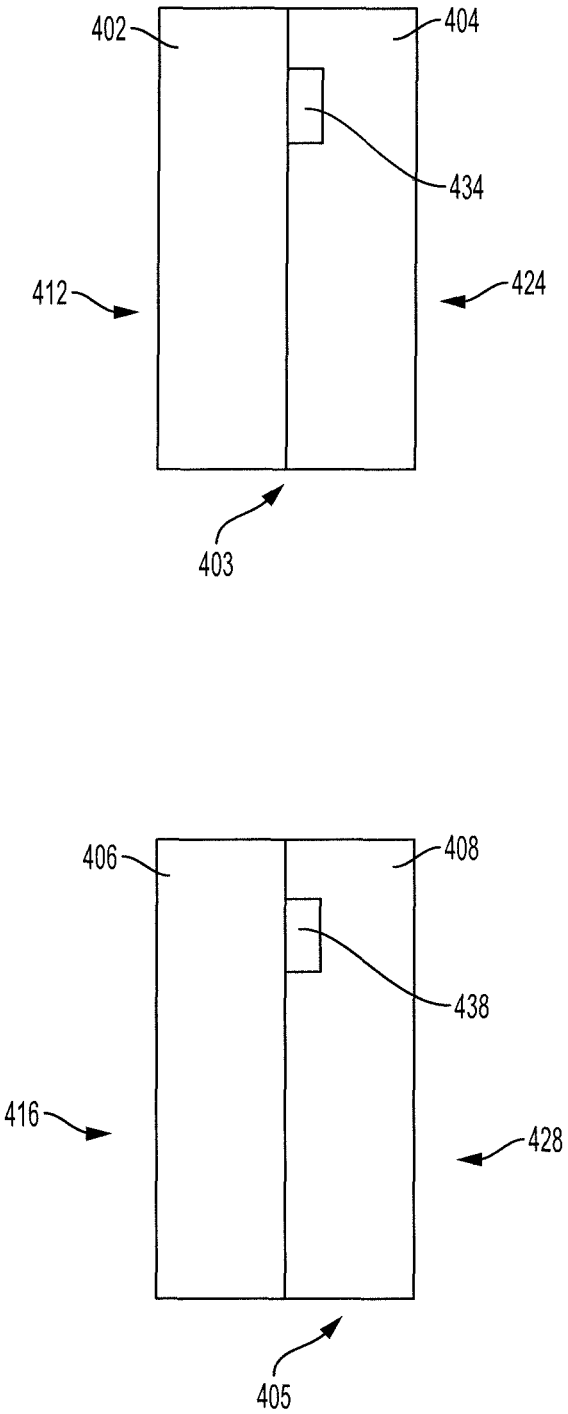
FIG. 4B illustrates side cross-sectional views of the four pieces illustrated in FIG. 4A when put together to form the waistband portion of the yoga band leggings, according to an aspect of the invention.

The waistband portion 102 may be made of a front waistband panel 116 and a back waistband panel 118. The front waistband panel 116 and the back waistband panel 118 may each be made of an interior piece and an exterior piece, as shown in FIGS. 4A and 4B and described herein.

Figure 2A:
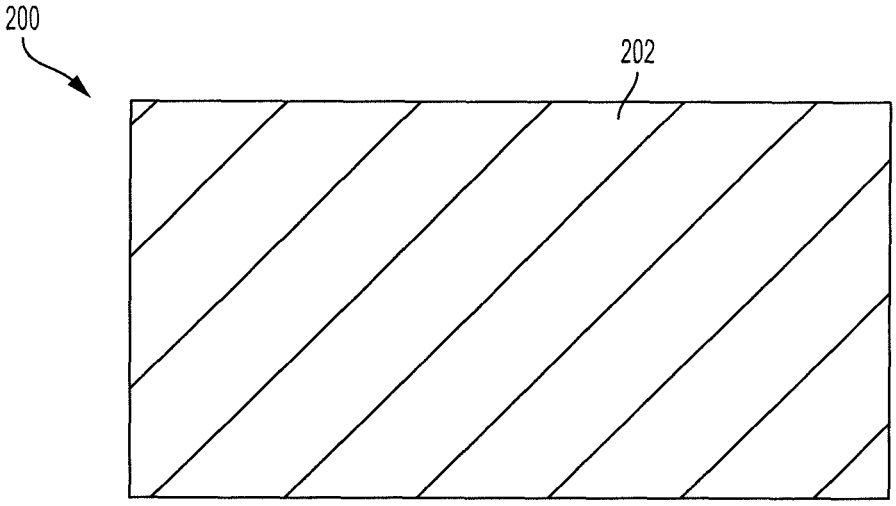
FIG. 2A illustrates a view of an outside surface of a fabric, according to an aspect of the invention.
Figure 2B:
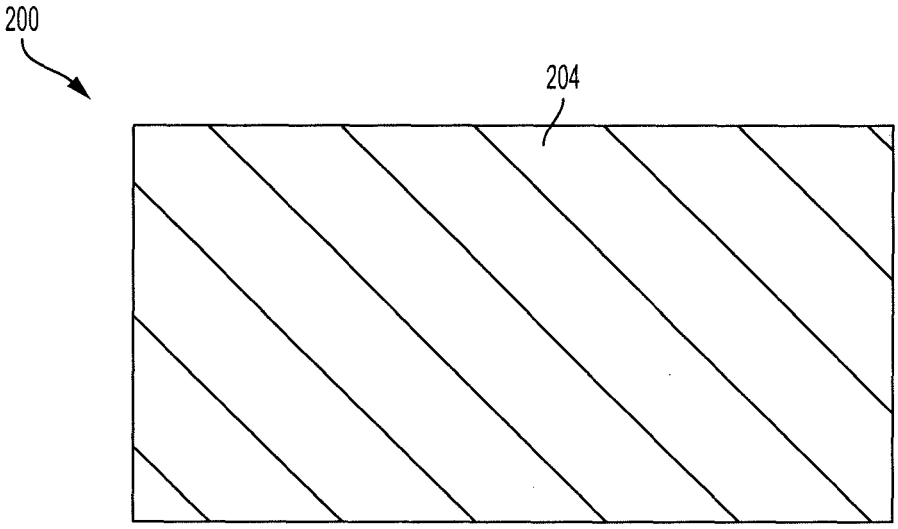
FIG. 2B illustrates a view of an inside surface of the fabric, according to an aspect of the invention.

FIG. 2A illustrates a view of an outside surface 202 of a fabric 200, according to an aspect of the invention. FIG. 2B illustrates a view of an inside surface 204 of the fabric 200, according to an aspect of the invention. The fabric 200 may be used to make the yoga band leggings 100. The fabric 200 may be made of 118D/192F Poly Filament Fiber yarn. The fabric 200 may be a 40D 8% Spandex, 28 gage fabric with a loop count of between 14.7 cm and 15.5 cm. In some embodiments, the loop count is 15 cm. The fabric 200 may have an outside surface 202 and an inside surface 204. When fabric is knit (or knitted) using yarn, the resulting two sides of the fabric may not have identical characteristics. The outside surface 202 may have a different feel and appearance from the inside surface 204. In this way, the outside surface 202 is distinct from the inside surface 204 of the fabric. One of skill in the art would be able to distinguish the outside surface 202 from the inside surface 204 when presented with the fabric 200.

In some other embodiments, the fabric 200 is made of a 100D+30D/114F yarn with a loop count between 10 and 20, preferably 13.5. In these other embodiments, the fabric is polyester/spandex DTY 190 grams, with the ratio of polyester to spandex being between 80/20 to 98/2, and preferably 92/8.

One or both surfaces of the fabric 200 may be processed before being used to make a garment, such as the yoga band leggings 100. The fabric 200 may be printed on or dyed to impart a pattern and/or color to the fabric 200. In addition, the fabric 200 may be brushed to alter and enhance the feel of the fabric 200.

Figure 3A:
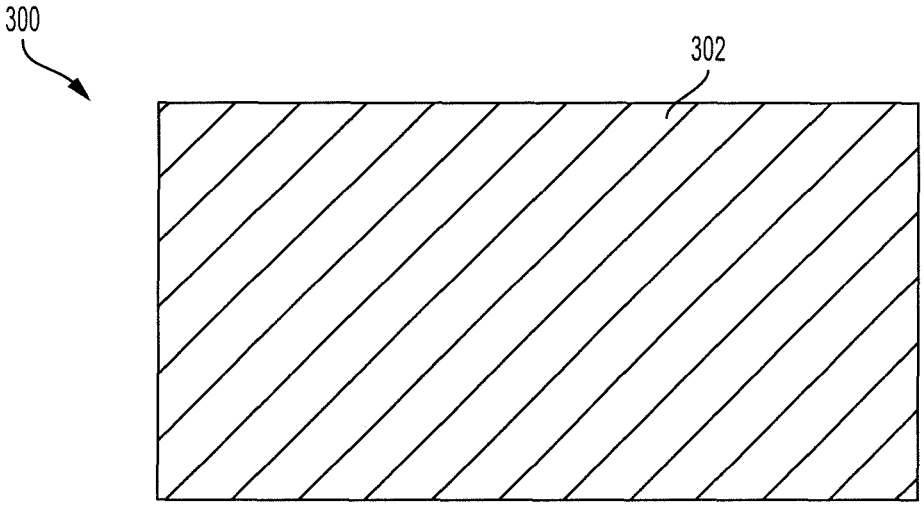
FIG. 3A illustrates a view of the outside surface of the fabric after being brushed once, according to an aspect of the invention.
Figure 3B:
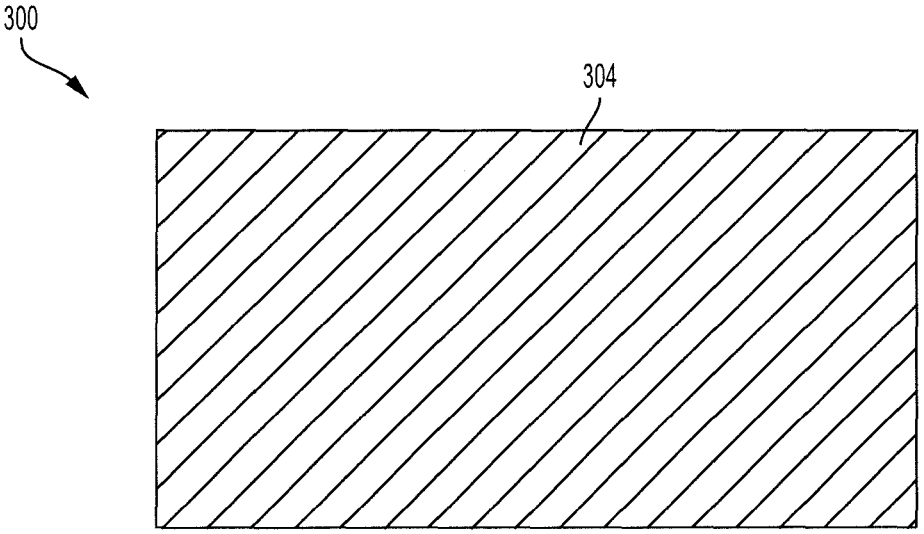
FIG. 3B illustrates a view of the inside surface of the fabric after being brushed multiple times, according to an aspect of the invention.

FIG. 3A illustrates a view of the single-brushed surface 302 of a brushed fabric 300 (similar to fabric 200), according to an aspect of the invention. FIG. 3B illustrates a view of the multiple-brushed surface 304 of the brushed fabric 300, according to an aspect of the invention. The outside surface 202 of the fabric 200 may be brushed once to create the single-brushed surface 302 of the brushed fabric 300. The inside surface 204 of the fabric 200 may be brushed multiple times to create the multiple-brushed surface 304 of the brushed fabric 300.

The outside surface 202 and the inside surface 204 may be brushed with an abrasive brush, such as a suede brush or a carbon brush. A brushing machine equipped with the abrasive brush may be used to brush the outside surface 202 and the inside surface 204. In some embodiments, the outside surface 202 and the inside surface 204 may be sanded or micro brushed.

Brushing a surface of the fabric 200 abrades the surface of the fabric 200 and loosens some of the fibers of the yarn used to make the fabric 200. Brushing the fabric 200 results in a brushed fabric 300 which has a softer feeling to human touch than before being brushed. Having a softer feeling is desirable, as the feeling of the fabric to a human hand is an important factor in the purchasing decision making of a prospective buyer of garments, such as the yoga band leggings 100. Fabrics which have been brushed only once may have a softer feel than fabrics which have not been brushed at all, but the hand feel increases as the fabric is brushed additional times.

As described herein, the inside surface 204 of the fabric 200 has different physical properties than the outside surface 202 of the fabric 200. Accordingly, brushing the inside surface 204 of the fabric 200 results in a different hand feel than brushing the outside surface 202 of the fabric 200. Conventionally, the outside surface 202 is used as the outside surface of a garment made of the fabric 200 and the inside surface 204 is used as the inside surface of the garment, which makes contact with the wearer. In these conventional garments, the outside surface 202 may be brushed once. In the yoga band leggings 100, the inside surface 204 is brushed multiple times to form the multiple-brushed surface 304 of brushed fabric 300, and is used as the outside surface (e.g., outer surface 112, 108) of the yoga band leggings 100. In some embodiments, the inside surface 204 of the fabric 200 is brushed two times. In other embodiments, the inside surface 204 of the fabric 200 is brushed three times. In yet other embodiments, the inside surface 204 of the fabric 200 is brushed four or more times. As described herein, each additional time the fabric is brushed, the hand feel of the fabric improves. However, increased brushing may weaken the fabric. A particular number of brushing cycles may be determined, optimizing the balance of hand feel (e.g., softness) and durability. Different fabrics may have different optimal number of times to be brushed.

Brushing the inside surface 204 of the fabric 200 and using the inside surface 204 as the outside surface of the yoga band leggings 100 is an unconventional approach. Brushing the inside surface 204 multiple times yielded unexpected results of improved hand feel of the fabric 200. Using the outside surface 202 as the inner surface of the yoga band leggings 100, and meant to be contacted to the wearer, is also an unconventional approach, which yielded unexpected results of comfort.

FIG. 4A illustrates front views of four waistband pieces used to make a waistband portion of the yoga band leggings, according to an aspect of the invention.

The waistband portion 102 of the yoga band leggings 100 are made of four waistband pieces 402-408. The first waistband piece 402 is a front exterior waistband piece and the second waistband piece 404 is a front interior waistband piece. The first waistband piece 402 and the second waistband piece 404 may be connected to form the front waistband panel 116.

The first waistband piece 402 has a first surface 412 and a second surface 422. The first surface 412 may be an outer-facing surface, such that the first surface 412 is exposed to the outside (e.g., the outer surface 108 of the front waistband panel 116). The second surface 422 may be an inner-facing surface opposite the outer-facing surface and facing the second waistband piece 404. The first waistband piece 402 is made of brushed fabric 300. The first surface 412 may be the multiple-brushed surface 304 and the second surface 422 may be the single-brushed surface 302, or the first surface 412 may be the single-brushed surface 302 and the second surface 422 may be the multiple-brushed surface 304.

The first waistband piece 402 has a top edge 492, a bottom edge 410, a left edge 472, and a right edge 482. The top edge 492 corresponds to the top of the waistband portion 102 of the yoga band leggings 100. The top edge 492 has a top edge length 452. The bottom edge 410 is configured to be connected to the top of the leg portion 104 of the yoga band leggings 100. The bottom edge 410 has a bottom edge length 462. The top edge length 452 is shorter than the bottom edge length 462. The top edge length 452 being shorter than the bottom edge length 462 results in a tapered or curved shape when the waistband portion 102 is assembled. The tapered shape allows for the yoga band leggings 100 to create a flattering look for the wearer of the yoga band leggings 100, as the tapered shape helps to surround and compress a midsection area of the wearer. While the first waistband piece 402, second waistband piece 404, third waistband piece 406, and the fourth waistband piece 408 are shown as being trapezoidal in shape with straight edges, the sides of each piece may be curved, either concave or convex, to create a different shape for the waistband portion 102 of the yoga band leggings 100.

The second waistband piece 404 is a front interior waistband piece. The second waistband piece 404 has a first surface 414 and a second surface 424. The first surface 414 may be an outer-facing surface, such that the first surface 414 faces away from the wearer and faces the first waistband piece 402. The second surface 424 may be an inner-facing surface opposite the outer-facing surface and making contact with the wearer (e.g., inner surface 106 of the waistband portion 102). The second waistband piece 404 is made of brushed fabric 300. The first surface 414 may be the multiple-brushed surface 304 and the second surface 424 may be the single-brushed surface 302, or the first surface 414 may be the single-brushed surface 302 and the second surface 424 may be the multiple-brushed surface 304.

The second waistband piece 404 has a top edge 494, a bottom edge 420, a left edge 474, and a right edge 484. The top edge 494 corresponds to the top of the waistband portion 102 of the yoga band leggings 100. The top edge 494 has a top edge length 454. The bottom edge 420 is configured to be connected to the top of the leg portion 104 of the yoga band leggings 100. The bottom edge 420 has a bottom edge length 464. The top edge length 454 is shorter than the bottom edge length 464. The top edge length 454 being shorter than the bottom edge length 464 results in a tapered or curved shape, as described herein.

The second waistband piece 404 is connected to the first waistband piece 402. The top edge 492 of the first waistband piece 402 may be connected to the top edge 454 of the second waistband piece 404. The bottom edge 410 of the first waistband piece 402 may be connected to the bottom edge 420 of the second waistband piece 404. The left edge 472 of the first waistband piece 402 may be connected to the right edge 484 of the second waistband piece 404. The right edge 482 of the first waistband piece 402 may be connected to the left edge 474 of the second waistband piece 404. The first waistband piece 402 and the second waistband piece 404 may be connected by sewing or stitching. In some embodiments, the first waistband piece 402 and the second waistband piece 404 may be connected by forming a bond using a fabric adhesive.

The second waistband piece 404 includes an elastic band 434 sewn or stitched to the first surface 414, such that the elastic band 434 does not directly contact the wearer's waist and is located between the first waistband piece 402 and the second waistband piece 404, as shown in FIG. 4B.

The elastic band 434 may be located at or near the top edge 494 of the second waistband piece 404. As used herein, near the top edge may be defined as being closer vertically to the top edge than the middle of the fabric piece. The elastic band 434 may have a width 444. In some embodiments, the width 444 is between one eighth (⅛th) of an inch and one inch. In some embodiments, the width 444 is one fourth (¼th) of an inch. The elastic band may be attached to the waistband portion using a coverstitch machine. In some embodiments, an overlock sewing machine can be used to overlock stitch the elastic band to the waistband portion. The elastic band is configured to hold the yoga band leggings 100 onto the body of the wearer, and to prevent the yoga band leggings 100 from falling or sliding down the body of the wearer.

While the first waistband piece 402 and the second waistband piece 404 are shown as being two different pieces of fabric sewn or stitched together, in some embodiments, the first waistband piece 402 and the second waistband piece 404 are one piece of fabric connected at the top edge 492 of the first waistband piece and the top edge 494 of the second waistband piece or connected at the bottom edge 410 of the first waistband piece 402 and the bottom edge 420 of the second waistband piece 404.

The third waistband piece 406 is a rear exterior waistband piece and the fourth waistband piece 408 is a rear interior waistband piece. The third waistband piece 406 and the fourth waistband piece 408 may be connected to form the back waistband panel 118.

The third waistband piece 406 has a first surface 416 and a second surface 426. The first surface 416 may be an outer-facing surface, such that the first surface 416 is exposed to the outside (e.g., the outer surface 108 of the front waistband panel 116). The second surface 426 may be an inner-facing surface opposite the outer-facing surface and facing the fourth waistband piece 408. The third waistband piece 406 is made of brushed fabric 300. The first surface 416 may be the multiple-brushed surface 304 and the second surface 426 may be the single-brushed surface 302, or the first surface 416 may be the single-brushed surface 302 and the second surface 426 may be the multiple-brushed surface 304.

The third waistband piece 406 has a top edge 496, a bottom edge 410, a left edge 476, and a right edge 486. The top edge 496 corresponds to the top of the waistband portion 102 of the yoga band leggings 100. The top edge 496 has a top edge length 456. The bottom edge 410 is configured to be connected to the top of the leg portion 104 of the yoga band leggings 100. The bottom edge 410 has a bottom edge length 466. The top edge length 456 is shorter than the bottom edge length 466. The top edge length 456 being shorter than the bottom edge length 466 results in a tapered or curved shape when the waistband portion 102 is assembled. The tapered shape allows for the yoga band leggings 100 to create a flattering look for the wearer of the yoga band leggings 100, as the tapered shape helps to surround and compress a midsection area of the wearer.

The fourth waistband piece 408 is a front interior waistband piece. The fourth waistband piece 408 has a first surface 418 and a second surface 428. The first surface 418 may be an outer-facing surface, such that the first surface 418 faces away from the wearer and faces the third waistband piece 406. The second surface 428 may be an inner-facing surface opposite the outer-facing surface and making contact with the wearer (e.g., inner surface 106 of the waistband portion 102). The fourth waistband piece 408 is made of brushed fabric 300. The first surface 418 may be the multiple-brushed surface 304 and the second surface 428 may be the single-brushed surface 302, or the first surface 418 may be the single-brushed surface 302 and the second surface 428 may be the multiple-brushed surface 304.

The fourth waistband piece 408 has a top edge 498, a bottom edge 420, a left edge 478, and a right edge 488. The top edge 498 corresponds to the top of the waistband portion 102 of the yoga band leggings 100. The top edge 498 has a top edge length 458. The bottom edge 420 is configured to be connected to the top of the leg portion 104 of the yoga band leggings 100. The bottom edge 420 has a bottom edge length 468. The top edge length 458 is shorter than the bottom edge length 468. The top edge length 458 being shorter than the bottom edge length 468 results in a tapered or curved shape, as described herein.

The fourth waistband piece 408 is connected to the third waistband piece 406. The top edge 496 of the third waistband piece 406 may be connected to the top edge 458 of the fourth waistband piece 408. The bottom edge 410 of the third waistband piece 406 may be connected to the bottom edge 420 of the fourth waistband piece 408. The left edge 476 of the third waistband piece 406 may be connected to the right edge 488 of the fourth waistband piece 408. The right edge 486 of the third waistband piece 406 may be connected to the left edge 478 of the fourth waistband piece 408. The third waistband piece 406 and the fourth waistband piece 408 may be connected by sewing or stitching. In some embodiments, the third waistband piece 406 and the fourth waistband piece 408 may be connected by forming a bond using a fabric adhesive.

The fourth waistband piece 408 includes an elastic band 438 sewn or stitched to the first surface 418, such that the elastic band 438 does not directly contact the wearer's waist and is located between the third waistband piece 406 and the fourth waistband piece 408, as shown in FIG. 4B.

The elastic band 438 may be located at or near the top edge 498 of the fourth waistband piece 408. The elastic band 438 may have a width 448. In some embodiments, the width 448 is between one eighth (⅛th) of an inch and one inch. In some embodiments, the width 448 is one fourth (¼th) of an inch. Though different reference numbers are used for the elastic bands 434 and 438, the elastic bands 434 and 438 may be one continuous elastic band. When the elastic bands 434 and 438 are one continuous elastic band, the continuous elastic band 434/438 may be sewn or stitched to a partially assembled waistband portion 102.

In some embodiments, the top edge lengths 452-458 are 7.75 inches and the bottom edge lengths 462-468 are 8.75 inches. In some embodiments, the top edge lengths 452-458 are 8.5 inches and the bottom edge lengths 462-468 are 10.5 inches. In some embodiments, the top edge lengths 452-458 are 9.25 inches and the bottom edge lengths 462-468 are 11 inches. In some embodiments, the top edge lengths 452-458 are 11.5 inches and the bottom edge lengths 462-468 are 13.5 inches. In some embodiments, the top edge lengths 452-458 are 15 inches and the bottom edge lengths 462-468 are 17 inches. In some embodiments, the top edge lengths 452-458 are 16.5 inches and the bottom edge lengths 462-468 are 18.5 inches.

In some embodiments, the ratio of top edge length 452-458 to bottom edge length is between 0.8095 and 0.8919. This particular ratio range of top edge length to bottom edge length is an unexpected result which contributes to the flattering effect of shaping the midsection of the wearer of the yoga band leggings 100.

While the third waistband piece 406 and the fourth waistband piece 408 are shown as being two different pieces of fabric sewn or stitched together, in some embodiments, the third waistband piece 406 and the fourth waistband piece 408 are one piece of fabric connected at the top edge 496 of the third waistband piece and the top edge 498 of the fourth waistband piece or connected at the bottom edge 430 of the third waistband piece 406 and the bottom edge 440 of the fourth waistband piece 408.

In an example embodiment, the first surface 412 of the first waistband piece 402 is the multiple-brushed surface 304 and the second surface 422 of the first waistband piece 402 is the single-brushed surface 302, the first surface 414 of the second waistband piece 404 is the single-brushed surface 302 and the second surface 424 of the second waistband piece 404 is the multiple-brushed surface 304, the first surface 416 of the third waistband piece 406 is the multiple-brushed surface 304 and the second surface 426 of the third waistband piece 406 is the single-brushed surface 302, and the first surface 418 of the fourth waistband piece 408 is the single-brushed surface 302 and the second surface 428 of the fourth waistband piece 408 is the multiple-brushed surface 304. In the example embodiment, the resulting waistband portion 102 has an outer surface made of the multiple-brushed surface 304 and substantially no portion of the single-brushed surface 302 is exposed.

FIG. 4B illustrates side cross-sectional views of a front waistband panel 403 and a rear waistband panel 405.

The side cross-sectional view of front waistband panel 403 (e.g., front waistband panel 116) shows the first waistband piece 402 connected to the second waistband piece 404, and between the first waistband piece 402 and the second waistband piece 404 is the elastic band 434. The first waistband piece 402 and the second waistband piece 404 are connected such that the first surface 412 of the first waistband piece 402 and the first surface 414 of the second waistband piece 404 are facing outward and capable of being touched by a wearer. Accordingly, the soft, multiple-brushed surface 304 may form the first surface 412 of the first waistband piece 402 and the first surface 414 of the second waistband piece 404.

The side cross-sectional view of rear waistband panel 405 (e.g., back waistband panel 118) shows the third waistband piece 406 connected to the fourth waistband piece 408, and between the third waistband piece 406 and the fourth waistband piece 408 is the elastic band 438. The third waistband piece 406 and the fourth waistband piece 408 are connected such that the first surface 416 of the third waistband piece 406 and the first surface 418 of the fourth waistband piece 408 are facing outward and capable of being touched by a wearer. Accordingly, the soft, multiple-brushed surface 304 may form the first surface 416 of the third waistband piece 406 and the first surface 418 of the fourth waistband piece 408.

Figure 5:
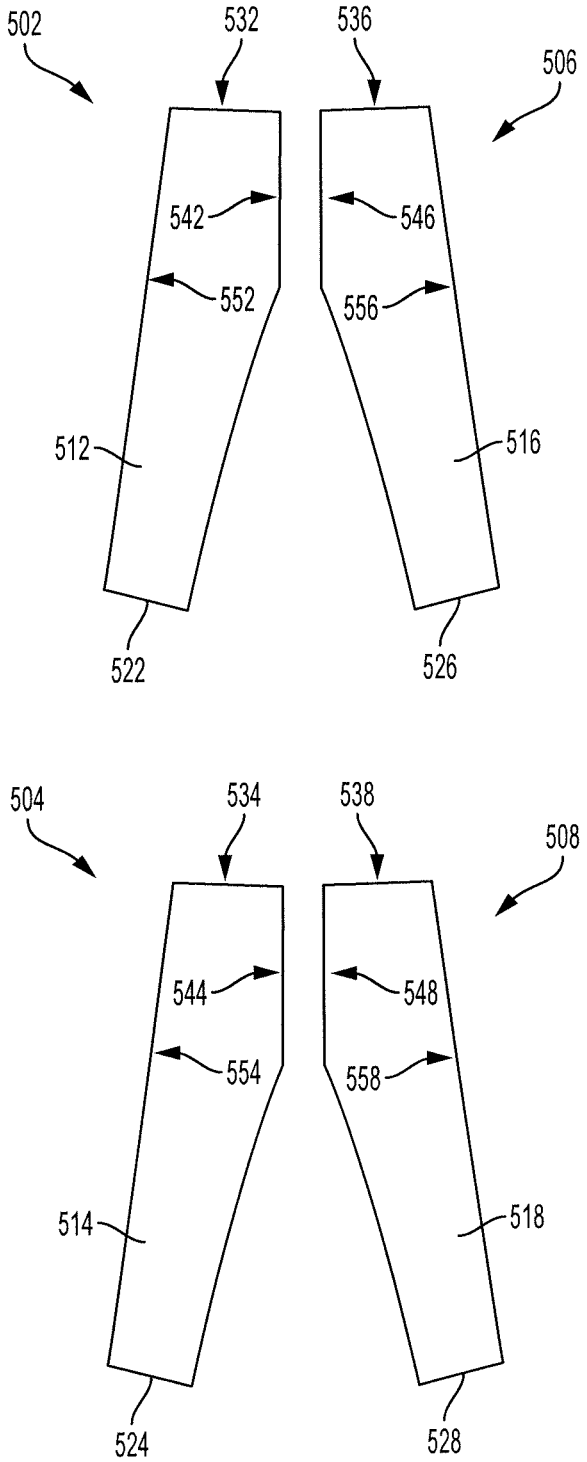
FIG. 5 illustrates views of four pieces used to make a leg portion of the yoga band leggings, according to an aspect of the invention.

FIG. 5 illustrates views of four leg pieces used to make a leg portion of the yoga band leggings, according to an aspect of the invention.

The leg portion 104 of the yoga band leggings 100 includes a first leg piece 502, a second leg piece 504, a third leg piece 506, and a fourth leg piece 508. The leg pieces 502-508 may be substantially similar in dimensions. In some embodiments, the first leg piece 502 is a front right leg piece, the second leg piece 504 is a rear right leg piece, the third leg piece is a front left leg piece, and the fourth leg piece is a rear left leg piece. The first leg piece 502 has a top edge 532, an inner edge 542, and an outer edge 552. The second leg piece 504 has a top edge 534, an inner edge 544, and an outer edge 554. The third leg piece 506 has a top edge 536, an inner edge 546, and an outer edge 556. The fourth leg piece 508 has a top edge 538, an inner edge 548, and an outer edge 558.

The top edges 532-538 are configured to be connected to the bottom edge of the waistband portion 102 of the yoga band leggings 100 (e.g., bottom edges 410, 420, 430, and 440). The inner edge 542 of the first leg piece 502 is connected to the inner edge 546 of the third leg piece 506, and the inner edge 544 of the second leg piece 504 is connected to the inner edge 548 of the fourth leg piece 508. The outer edge 552 of the first leg piece 502 is connected to the outer edge 554 of the second leg piece 504. The outer edge 556 of the third leg piece 506 is connected to the outer edge 558 of the fourth leg piece 508. The leg pieces 502-508 may be connected to each other and to the waistband portion 102 by stitching or sewing.

The first leg piece 502 has an outer surface 512 and an inner surface 522. The second leg piece 504 has an outer surface 514 and an inner surface 524. The third leg piece 506 has an outer surface 516 and an inner surface 526. The fourth leg piece 508 has an outer surface 518 and an inner surface 528. The outer surfaces 512-518 may be the multiple-brushed surface 304 of the brushed fabric 300. The inner surfaces 522-528 may be the single-brushed surface 302 of the brushed fabric 300. The inner surfaces 522-528 are configured to be contacted with the wearer. Once assembled, the inner surfaces 522-528 form the inner leg surface 110 as shown in FIG. 1, and the outer surfaces 512-518 form the outer leg surface 112 as shown in FIG. 1.

Figure 6:
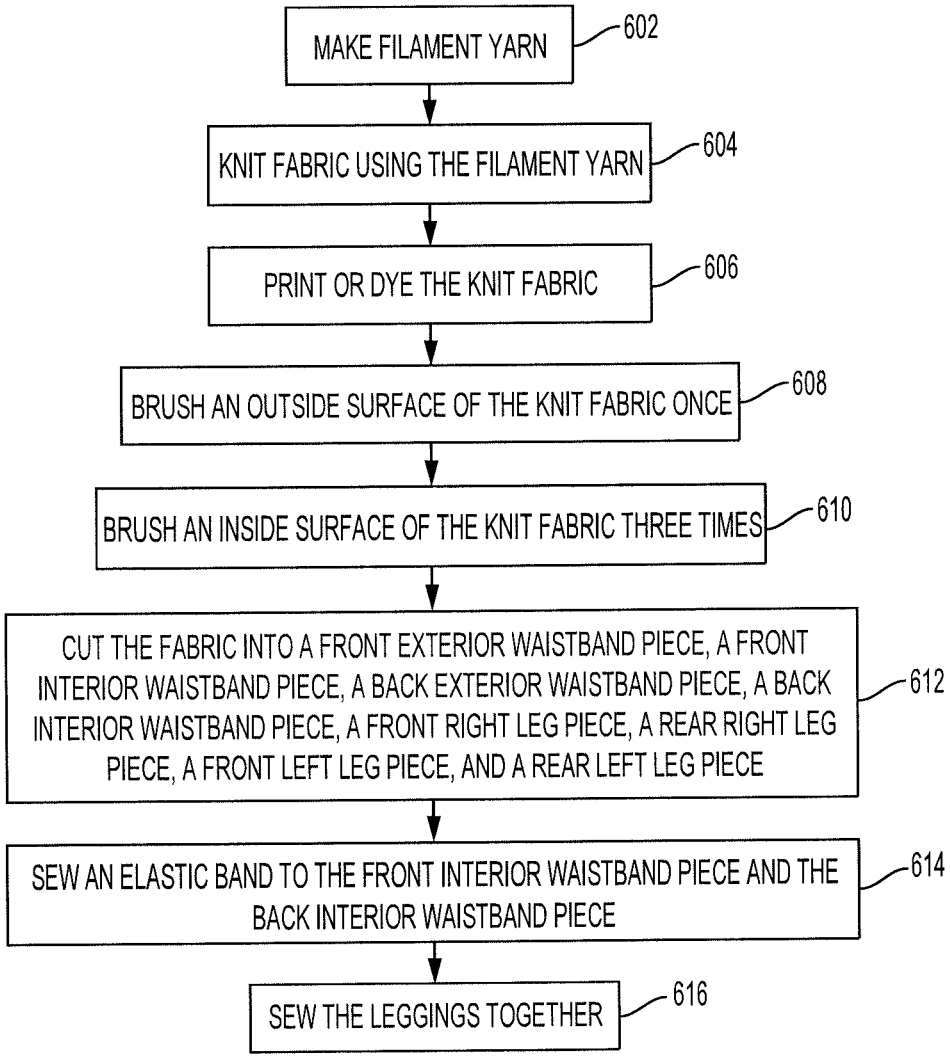
FIG. 6 is a flowchart of the method of manufacturing the yoga band leggings, according to an aspect of the invention.

FIG. 6 is a flowchart of the method of manufacturing the yoga band leggings, according to an aspect of the invention.

A filament yarn is made (step 602). As described herein, the filament yarn may be 118D/192F Poly Filament Fiber yarn. A fabric is knit using the filament yarn (step 604). As described herein, the fabric may be a 40D 8% Spandex, 28 gage fabric with a loop count of between 14.7 cm and 15.5 cm. The knit fabric is printed on or dyed, to impart a pattern or color onto the fabric (step 606). The knit fabric has an outside surface and an inside surface (e.g., outside surface 202 and inside surface 204 of fabric 200). The outside surface is brushed once to form a single-brushed surface (e.g., single-brushed surface 302) (step 608). As described herein, the outside surface may be brushed by an abrasive brush, such as a carbon or suede brush. The inside surface is brushed three times to form a multiple-brushed surface (e.g., multiple-brushed surface 304) (step 610). The multiple brushing gives the inside surface a soft hand feel. The fabric is cut into a front exterior waistband piece, a front interior waistband piece, a rear exterior waistband piece, and a rear interior waistband piece, as well as a front right leg piece, a rear right leg piece, a front left leg piece, and a rear left leg piece (step 612). An elastic band is sewn or stitched to the front interior waistband piece and the rear interior waistband piece (step 614). The cut fabric pieces are sewn or stitched together, as described and illustrated herein (step 616). In some embodiments, the elastic band is ¼th (one fourth) of an inch wide. In some embodiments, after the yoga band leggings 100 are assembled, they are packed into storage containers and shipped to retailers or customers.

Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A method of manufacturing leggings having a leg portion and a waistband portion, using a fabric, the method comprising:

brushing an outside surface of the fabric once to form a single-brushed surface;

brushing an inside surface of the fabric exactly three times to form a triple-brushed surface;

cutting the fabric into a plurality of leg pieces for the leg portion and a plurality of waistband pieces for the waistband portion;

sewing or stitching the plurality of leg pieces for the leg portion and the plurality of waistband pieces for the waistband portion together, the waistband portion having a top edge and a bottom edge, a length of the top edge of the waistband portion being smaller than a length of the bottom edge of the waistband portion, the bottom edge of the waistband portion being connected to a top edge of the leg portion, the single-brushed surface of the fabric forming an inside leg surface configured to contact legs of a wearer of the leggings, the triple-brushed surface of the fabric forming an outside leg surface, a front outside waistband surface, and a rear outside waistband surface; and sewing or stitching an elastic band to the top edge of the waistband portion.

2. The method of claim 1, wherein cutting the fabric into the plurality of pieces for the waistband section comprises cutting the fabric to form a front exterior waistband piece, a front interior waistband piece, a rear exterior waistband piece, and a rear interior waistband piece.

3. The method of claim 2, wherein sewing or stitching the plurality of pieces for the leg portion and the plurality of pieces for the waistband portion together comprises sewing or stitching the front exterior waistband piece, the front interior waistband piece, the rear exterior waistband piece, and the rear interior waistband piece together such that the front exterior waistband piece and the rear exterior waistband piece form an outside waistband surface and the front interior waistband piece and the rear interior waistband piece form an inside waistband surface, the outside waistband surface including the front outside waistband surface and the rear outside waistband surface.

4. The method of claim 3, wherein sewing or stitching the elastic band to the top edge of the waistband portion comprises sewing or stitching the elastic band to the front interior waistband piece and the rear interior waistband piece such that the elastic band is located between the front interior waistband piece and the front exterior waistband piece and located between the rear interior waistband piece and the rear exterior waistband piece.

5. The method of claim 1, wherein brushing the outside surface of the fabric comprises brushing the outside surface of the fabric with a carbon or suede brush, and wherein brushing the inside surface of the fabric comprises brushing the inside surface of the fabric with the carbon or suede brush.

6. The method of claim 1, wherein cutting the fabric into a plurality of pieces for the waistband section comprises cutting the fabric to form a front waistband piece having the front outside waistband surface and a rear waistband piece having the rear outside waistband surface.

7. A method of manufacturing leggings having a leg portion and a waistband portion, using a fabric, the method comprising:

brushing an outside surface of the fabric once to form a single-brushed surface;

brushing an inside surface of the fabric exactly three times to form a triple-brushed surface;

cutting the fabric into a plurality of leg pieces for the leg portion;

cutting the fabric into a plurality of waistband pieces for the waistband portion, the plurality of waistband pieces including a front exterior waistband piece, a front interior waistband piece, a rear exterior waistband piece, and a rear interior waistband piece;

sewing or stitching the plurality of leg pieces for the leg portion, the single-brushed surface of the fabric forming an inside leg surface configured to contact legs of a wearer of the leggings and the triple-brushed surface of the fabric forming an outside leg surface; and sewing or stitching the front exterior waistband piece, the front interior waistband piece, the rear exterior waistband piece, and the rear interior waistband piece together such that the front exterior waistband piece and the rear exterior waistband piece form an outside waistband surface and the front interior waistband piece and the rear interior waistband piece form an inside waistband surface, the triple-brushed surface of the fabric forming the outside waistband surface and the inside waistband surface.

8. The method of claim 7, further comprising sewing or stitching an elastic band to the front interior waistband piece and the rear interior waistband piece such that the elastic band is located between the front interior waistband piece and the front exterior waistband piece and located between the rear interior waistband piece and the rear exterior waistband piece.

9. The method of claim 7, wherein brushing the outside surface of the fabric comprises brushing the outside surface of the fabric with a carbon or suede brush, and wherein brushing the inside surface of the fabric comprises brushing the inside surface of the fabric with the carbon or suede brush.

10. A method of manufacturing leggings having a leg portion and a waistband portion, using a fabric, the method comprising:

knitting a fabric using a filament yarn, the fabric having an outside surface and an inside surface, the outside surface having a different feel from the inside surface;

brushing the outside surface of the fabric once to form a single-brushed surface;

brushing the inside surface of the fabric multiple times to form a multiple-brushed surface;

cutting the fabric into a plurality of leg pieces for the leg portion and a plurality of waistband pieces for the waistband portion;

sewing or stitching the plurality of leg pieces for the leg portion and the plurality of waistband pieces for the waistband portion together, the waistband portion having a top edge and a bottom edge, a length of the top edge of the waistband portion being smaller than a length of the bottom edge of the waistband portion, the bottom edge of the waistband portion being connected to a top edge of the leg portion, the single-brushed surface of the fabric forming an inside leg surface configured to contact legs of a wearer of the leggings, and the multiple-brushed surface of the fabric forming an outside leg surface, such that the outside surface of the fabric contacts the legs of the wearer of the leggings and the inside surface of the fabric does not contact the legs of the wearer of the leggings; and sewing or stitching an elastic band to the top edge of the waistband portion.

11. The method of claim 10, wherein brushing the inside surface of the fabric multiple times comprises brushing the inside surface of the fabric exactly three times.

12. The method of claim 10, wherein cutting the fabric into a plurality of pieces for the waistband section comprises cutting the fabric to form a front exterior waistband piece, a front interior waistband piece, a rear exterior waistband piece, and a rear interior waistband piece.

13. The method of claim 12, wherein sewing or stitching the plurality of pieces for the leg portion and the plurality of pieces for the waistband portion together comprises sewing or stitching the front exterior waistband piece, the front interior waistband piece, the rear exterior waistband piece, and the rear interior waistband piece together such that the front exterior waistband piece and the rear exterior waistband piece form an outside waistband surface and the front interior waistband piece and the rear interior waistband piece form an inside waistband surface.

14. The method of claim 13, wherein sewing or stitching the elastic band to the top edge of the waistband portion comprises sewing or stitching the elastic band to the front interior waistband piece and the rear interior waistband piece such that the elastic band is located between the front interior waistband piece and the front exterior waistband piece and located between the rear interior waistband piece and the rear exterior waistband piece.

15. The method of claim 10, wherein brushing the outside surface of the fabric comprises brushing the outside surface of the fabric with a carbon or suede brush, and wherein brushing the inside surface of the fabric comprises brushing the inside surface of the fabric with the carbon or suede brush.

16. The method of claim 10, wherein cutting the fabric into a plurality of pieces for the waistband section comprises cutting the fabric to form a front waistband piece and a rear waistband piece.

* * * * *